US010067446B1

(12) United States Patent
Kitada

(10) Patent No.: US 10,067,446 B1
(45) Date of Patent: Sep. 4, 2018

(54) IMAGE FORMING APPARATUS, METHOD OF CONTROLLING IMAGE FORMING APPARATUS, AND CONTROL PROGRAM OF IMAGE FORMING SYSTEM

(71) Applicant: Konica Minolta, Inc., Tokyo (JP)

(72) Inventor: Tomo Kitada, Yokohama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/900,231

(22) Filed: Feb. 20, 2018

(30) Foreign Application Priority Data

Mar. 1, 2017 (JP) ..... 2017-038030

(51) Int. Cl.
*G03G 15/00* (2006.01)
*G03G 21/00* (2006.01)
*G03G 15/16* (2006.01)

(52) U.S. Cl.
CPC ..... *G03G 15/161* (2013.01); *G03G 15/5054* (2013.01); *G03G 21/0011* (2013.01); *G03G 2215/1661* (2013.01)

(58) Field of Classification Search
CPC ..... G03G 15/161; G03G 15/5054; G03G 21/0011; G03G 2215/1661
See application file for complete search history.

(56) References Cited

U.S. PATENT DOCUMENTS 5,264,904 A * 11/1993 Audi ..... G03G 21/0029 15/256.5
8,112,027 B2 * 2/2012 Thayer ..... G03G 21/0029 399/345

FOREIGN PATENT DOCUMENTS

JP 2008122466 A 5/2008

* cited by examiner

*Primary Examiner* — Hoang Ngo
(74) *Attorney, Agent, or Firm* — Lucas & Mercanti, LLP

(57) ABSTRACT

An image forming apparatus includes: a cleaning device including a cleaning member that abuts a surface of an image carrier and cleans a surface of the image carrier; a detector that detects a stain generated on the surface of the image carrier in a moving direction of the surface of the image carrier; an adjusting mechanism that adjusts a relative position between the image carrier and the cleaning member in a direction orthogonal to the moving direction; and a hardware processor that controls the relative position between the image carrier and the cleaning member by driving the adjusting mechanism based on information regarding the stain detected by the detector.

14 Claims, 14 Drawing Sheets

IMAGE FORMING APPARATUS, METHOD OF CONTROLLING IMAGE FORMING APPARATUS, AND CONTROL PROGRAM OF IMAGE FORMING SYSTEM

The entire disclosure of Japanese patent Application No. 2017-038030, filed on Mar. 1, 2017, is incorporated herein by reference in its entirety.

BACKGROUND

Technological Field

The present invention relates to an image forming apparatus, a method of controlling the image forming apparatus, and a control program of an image forming system, and especially relates to an electrophotographic image forming apparatus and a method of controlling the image forming apparatus, and a control program of an image forming system in which a plurality of image forming apparatuses is connected via a network.

Description of the Related Art

An electrophotographic image forming apparatus includes a cleaning device which cleans a surface of an image carrier by allowing a cleaning member referred to as a cleaning blade to abut the surface of the image carrier such as a photoreceptor and an intermediate transfer belt. The cleaning member cleans the surface of the image carrier by removing a residual material (adhering material) such as toner and paper dust remaining on the surface of the image carrier.

In this type of cleaning device, a streaky stain (a so-called, FD streak/sub scanning streak) might be generated on the surface of the image carrier in a follow direction (FD) direction (sub scanning direction) being a rotational direction (moving direction) of the image carrier due to deterioration of the cleaning member and the like. More specifically, a streaky stain is generated on the surface of the image carrier by slip-out of the residual material due to chipping of the cleaning member or slip-out of the residual material due to entrapment of a foreign material. Especially, in a case of the stain caused by the chipping of the cleaning member, this is continuously generated unless the cleaning member is replaced, so that production stops until a service person arrives and replaces the cleaning member.

Therefore, in order to suppress quality deterioration of an output image by the sub scanning streak without replacing the cleaning member, conventionally, the sub scanning streak is detected based on an image formed on recording paper, and contents of a screen process of an area corresponding to the sub scanning streak are changed based on a detection result (for example, refer to JP 2008-122466 A).

In the conventional technology disclosed in JP 2008-122466 A, quality deterioration of the output image by the sub scanning streak is suppressed by changing the contents of the screen process of the area corresponding to the sub scanning streak. However, in the conventional technology disclosed in JP 2008-122466 A, although it is possible to make the sub scanning streak inconspicuous by changing the contents of the screen process, it is not possible to eliminate the streaky stain itself generated on the surface of the image carrier.

SUMMARY

An object of the present invention is to provide an image forming apparatus capable of eliminating a streaky stain itself generated on a surface of an image carrier due to deterioration of a cleaning member and the like, a control method of the image forming apparatus, and a control program of an image forming system including the image forming apparatus.

To achieve the abovementioned object, according to an aspect of the present invention, an image forming apparatus reflecting one aspect of the present invention comprises:

a cleaning device including a cleaning member that abuts a surface of an image carrier and cleans a surface of the image carrier;

a detector that detects a stain generated on the surface of the image carrier in a moving direction of the surface of the image carrier;

an adjusting mechanism that adjusts a relative position between the image carrier and the cleaning member in a direction orthogonal to the moving direction; and a hardware processor that controls the relative position between the image carrier and the cleaning member by driving the adjusting mechanism based on information regarding the stain detected by the detector.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
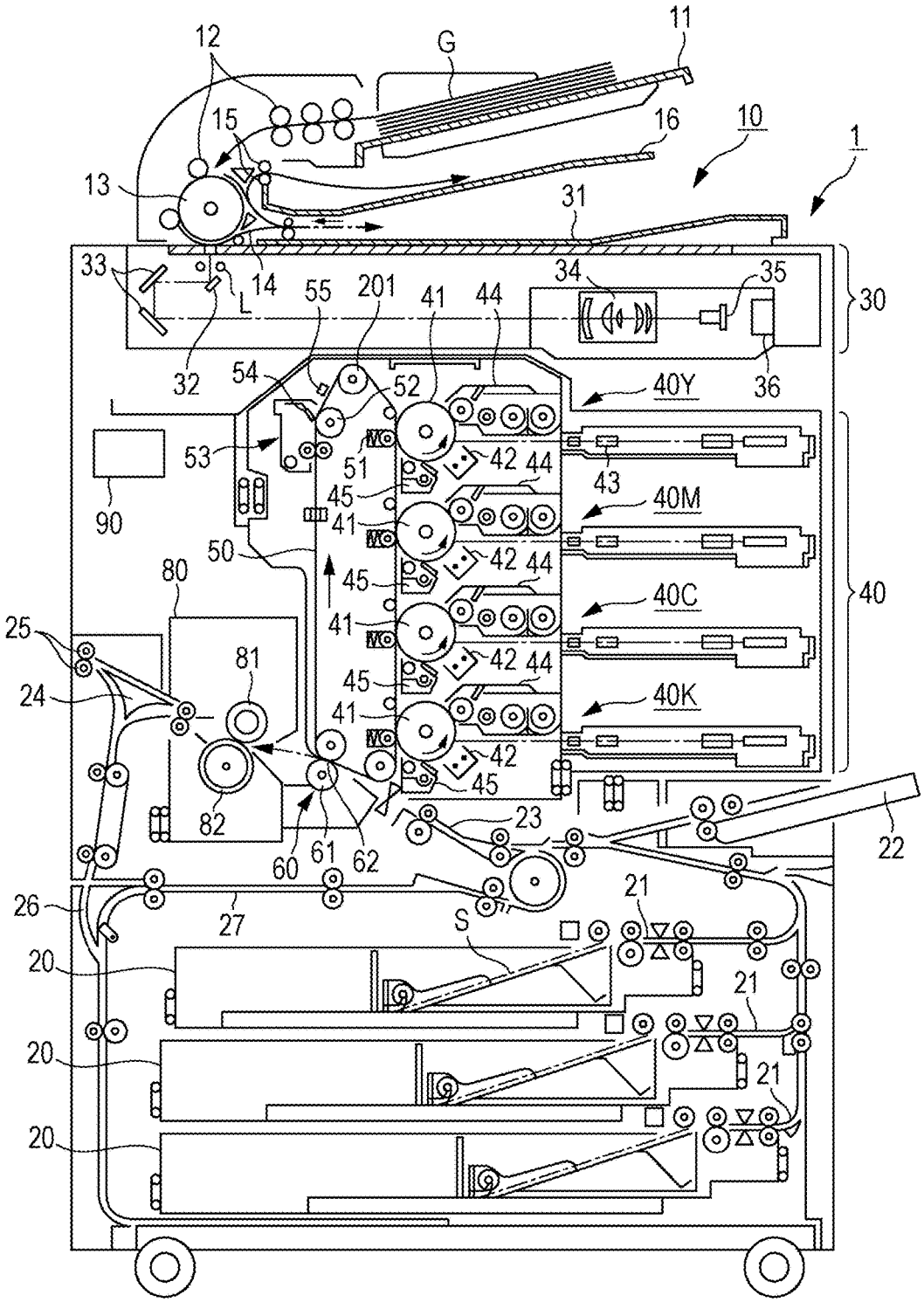
FIG. 1 is an overall configuration diagram schematically illustrating a system configuration of an image forming apparatus according to one embodiment of the present invention.

Hereinafter, a mode for carrying out the present invention (hereinafter, referred to as an "embodiment") will be described in detail with reference to the drawings. However, the scope of the invention is not limited to the disclosed embodiments. The present invention is not limited to the embodiment, and various numerical values and the like in the embodiment are examples. Meanwhile, in the following description and drawings, the same element or the element having the same function is assigned with the same reference numeral and the description thereof is not repeated.

[System Configuration of Image Forming Apparatus]

FIG. 1 is an overall configuration diagram schematically illustrating a system configuration of an image forming apparatus according to an embodiment of the present invention. In this embodiment, a case of applying to a copying machine which is an example of the image forming apparatus is taken as an example.

An image forming apparatus 1 according to this embodiment adopts an electrophotographic method for forming an image by using static electricity, and is a tandem color image forming apparatus which overlays toner of four colors of yellow (Y), magenta (M), cyan (C), and black (K). The image forming apparatus 1 includes a document conveying unit 10, a paper storage unit 20, an image reading unit 30, an image forming unit 40, an intermediate transfer belt 50, a secondary transfer unit 60, a fixing unit 80, and a control substrate 90.

The document conveying unit 10 includes a document feeder 11 on which a document is set, a plurality of rollers 12, a conveying drum 13, a conveyance guide 14, a document ejecting roller 15, and a document ejecting tray 16. A document G set on the document feeder 11 is conveyed one by one to a reading position of the image reading unit 30 by the plurality of rollers 12 and the conveying drum 13. The conveyance guide 14 and the document ejecting roller 15 eject the document G conveyed by the plurality of rollers 12 and the conveying drum 13 to the document ejecting tray 16.

The image reading unit 30 reads an image of the document G conveyed by the document conveying unit 10 or a document placed on a document table 31 to generate image data. Specifically, the image of the document G is irradiated by a lamp L. Reflected light from the document G based on irradiation light from the lamp L is guided to a first mirror unit 32, a second mirror unit 33, and a lens unit 34 in this order to form an image on a light receiving surface of an image sensor 35. The image sensor 35 photoelectrically converts incident light and outputs a predetermined image signal. The image signal output from the image sensor 35 is subjected to A/D conversion and image data is created.

The image data generated by the image reading unit 30 is supplied to an image processing unit 36. The image processing unit 36 performs well-known image processing such as shading correction, dither processing, and compression on the image data created by the A/D conversion by the image reading unit 30, and stores the same in a RAM 103 (refer to FIG. 6) of a controller 100 mounted on the control substrate 90. Meanwhile, the image data is not limited to the data output from the image reading unit 30; this may also be data received from an external device such as a personal computer connected to the image forming apparatus 1 and another image forming apparatus.

A plurality of paper storage units 20 is arranged in a lower portion of an apparatus main body according to a size and a type of paper S which is an example of a recording medium. The paper S is fed by a paper feeder 21 to be sent to the conveying unit 23, and is conveyed to the secondary transfer unit 60 being a transfer position by the conveying unit 23. A manual feeder 22 is provided in the vicinity of the paper storage unit 20. Special paper such as paper of a size which is not stored in the paper storage unit 20, tag paper with a tag, and an OHP sheet which is set by the user is sent from the manual feeder 22 to the transfer position.

The conveying unit 23 provided downstream of the secondary transfer unit 60 includes a conveying roller and a registration roller pair 71 provided in the vicinity of the secondary transfer unit 60. The registration roller pair 71 is formed of a pair of rollers including a driving roller 71*a* and a driven roller 71*b* arranged in a state of being pressed against an upper side of the driving roller 71*a*. A nip part formed between the driving roller 71*a* and the driven roller 71*b* serves as a conveying path for the paper S.

The paper S fed from the paper feeder 21 to be sent to the conveying unit 23 is conveyed to the secondary transfer unit 60 which is the transfer position by the conveying roller and the registration roller pair 71. The registration roller pair 71 delivers the paper S to the secondary transfer unit 60 at timing when the toner image may be transferred by the secondary transfer unit 60.

The image forming unit 40 and the intermediate transfer belt 50 being an image carrier are arranged between the image reading unit 30 and the paper storage unit 20. The image forming unit 40 includes four image forming units 40Y, 40M, 40C, and 40K for forming toner images of respective colors of yellow (Y), magenta (M), cyan (C), and black (K).

The image forming unit 40Y forms a yellow toner image, and the image forming unit 40M forms a magenta toner image. The image forming unit 40C forms a cyan toner image, and the image forming unit 40K forms a black toner image. The four image forming units 40Y, 40M, 40C, and 40K have the same configuration. Therefore, the image forming unit 40Y for forming the yellow toner image is herein described.

The image forming unit 40Y includes a drum-shaped photoreceptor (photosensitive drum) 41 being the image carrier, a charging unit 42, an exposing unit 43, a developing unit 44, and a cleaning device 45 arranged around the photoreceptor 41. The photoreceptor 41 rotates under driving of a driving motor not illustrated. The charging unit 42 uniformly charges a surface of the photoreceptor 41 by applying an electric charge to the photoreceptor 41. The exposing unit 43 forms an electrostatic latent image on the photoreceptor 41 by exposing the surface of the photoreceptor 41 based on the image data read from the document G or the image data transmitted from the external device.

The developing unit 44 develops the electrostatic latent image formed on the photoreceptor 41 by using two-component developer formed of toner and carrier. The toner is a particle which forms an image. The carrier has a function of giving an appropriate electric charge to the toner by frictional charging when mixed with the toner in the developing unit 44, and a function of conveying the toner to a developing area opposed to the photoreceptor 41, a function of forming a developing electric field so that the toner may develop truly on the electrostatic latent image on the photoreceptor 41. This developing unit 44 allows yellow toner to adhere to the electrostatic latent image formed on the photoreceptor 41. As a result, the yellow toner image is formed on the surface of the photoreceptor 41.

Meanwhile, the developing unit 44 of the image forming unit 40M allows magenta toner to adhere to the photoreceptor 41 of the image forming unit 40M. The developing unit 44 of the image forming unit 40C allows cyan toner to adhere to the photoreceptor 41 of the image forming unit 40C. The developing unit 44 of the image forming unit 40K allows black toner to adhere to the photoreceptor 41 of the image forming unit 40K.

The intermediate transfer belt 50 is formed to have an endless shape and is stretched around a plurality of rollers including a steering roller 201. The intermediate transfer belt 50 rotates in a clockwise direction opposite to a rotational direction of the photoreceptor 41 under driving by a driving motor not illustrated. A primary transfer unit 51 is provided in a position opposed to the photoreceptor 41 of each of the image forming units 40Y, 40M, 40C, and 40K on the intermediate transfer belt 50.

The primary transfer unit 51 applies voltage having polarity opposite to that of the toner to the intermediate transfer belt 50, thereby transferring the toner adhering to the photoreceptor 41 to the intermediate transfer belt 50. As the intermediate transfer belt 50 rotates, the toner images formed by the four image forming units 40Y, 40M, 40C, and 40K are sequentially transferred to a surface of the intermediate transfer belt 50. As a result, the yellow, magenta, cyan, and black toner images are superimposed on the intermediate transfer belt 50, thereby forming a color image.

The cleaning device 45 cleans the surface of the photoreceptor 41 after transferring the toner adhering to the photoreceptor 41 which is the image carrier to the intermediate transfer belt 50; specifically, this removes a residual material (adhering material) such as the toner (residual toner) remaining on the surface of the photoreceptor 41.

The secondary transfer unit 60 is arranged in the vicinity of the intermediate transfer belt 50 and downstream of the conveying unit 23 in a paper conveying direction. The secondary transfer unit 60 is formed of a transfer roller pair formed of a transfer upper roller 62 on which the intermediate transfer belt 50 is stretched and a transfer lower roller 61 pressed against the transfer upper roller 62 with the intermediate transfer belt 50 interposed therebetween.

In the secondary transfer unit 60, the paper S interposed between the registration roller pair 71 to be conveyed by the conveying unit 23 is pressed against the intermediate transfer belt 50 by the transfer lower roller 61. The secondary transfer unit 60 transfers a color toner image formed on an outer peripheral surface of the intermediate transfer belt 50 onto the paper S sent from the conveying unit 23.

The cleaning device 53 cleans the surface of the intermediate transfer belt 50 after the toner image transferred to the intermediate transfer belt 50 as the image carrier is transferred to the paper S; specifically, this removes the residual material (adhering material) such as the toner remaining on the surface of the intermediate transfer belt 50 (residual toner).

A fixing unit 80 is provided on an ejecting side of the paper S in the secondary transfer unit 60. The fixing unit 80 pressurizes and heats the paper S, thereby fixing the transferred toner image to the paper S. The fixing unit 80 is formed of, for example, a fixing upper roller 81 and a fixing lower roller 82 which are a pair of fixing members. The fixing upper roller 81 and the fixing lower roller 82 are arranged in a state pressurized against each other, and a fixing nip part is formed as a pressuring portion between the fixing upper roller 81 and the fixing lower roller 82.

A heating unit is provided inside the fixing upper roller 81. A roller unit of the fixing upper roller 81 is heated by radiant heat from this heating unit. Then, the heat of the roller unit of the fixing upper roller 81 is transmitted to the paper S, so that the toner image on the paper S is fixed.

The paper S is conveyed such that a surface (fixing target surface) on which the toner image is transferred by the secondary transfer unit 60 faces the fixing upper roller 81 and passes through the fixing nip part. Therefore, the paper S passing through the fixing nip part is pressurized by the fixing upper roller 81 and the fixing lower roller 82, and heated by the heat of the roller unit of the fixing upper roller 81.

A switching gate 24 is arranged downstream of the fixing unit 80 in the conveying direction of the paper S. The switching gate 24 switches the conveying path of the paper S passing through the fixing unit 80. That is, the switching gate 24 allows the paper S to move straight in a case of performing face-up paper ejection when forming an image on one side of the paper S. As a result, the paper S is ejected by a pair of paper ejecting rollers 25. The switching gate 24 guides the paper S downward in a case of performing face-down paper ejection when forming an image on one side of the paper S and in a case of forming images on both sides of the paper S.

When performing the face-down paper ejection, after the paper S is guided downward by the switching gate 24, the paper S is reversed and conveyed upward by the paper reversing/conveying unit 26. As a result, the reversed paper S is ejected by the pair of paper to ejecting rollers 25. In a case of forming images on both sides of the paper S, after the paper S is guided downward by the switching gate 24, the paper S is reversed by the paper reversing/conveying unit 26. Then, the reversed paper S is sent to the transfer position again by a paper re-feed path 27.

A post-processing device which folds the paper S and staples the paper S may be arranged downstream of the pair of paper ejecting rollers 25.

[Basic Configuration of Cleaning Device]

Subsequently, a cleaning device which removes the residual material such as the toner remaining on the image carrier will be described. A cleaning device 53 which removes the toner (residual toner) and the like remaining on the surface of the intermediate transfer belt 50 being the image carrier is herein described as an example.

As illustrated in FIG. 1, the cleaning device 53 includes a cleaning blade 54 as a cleaning member. The cleaning blade 54 abuts the surface of the intermediate transfer belt 50 in the vicinity of one of the plurality of rollers (the roller 52) around which the intermediate transfer belt 50 is stretched, and removes the residual material such as the toner remaining on the surface of the intermediate transfer belt 50.

Figure 2:
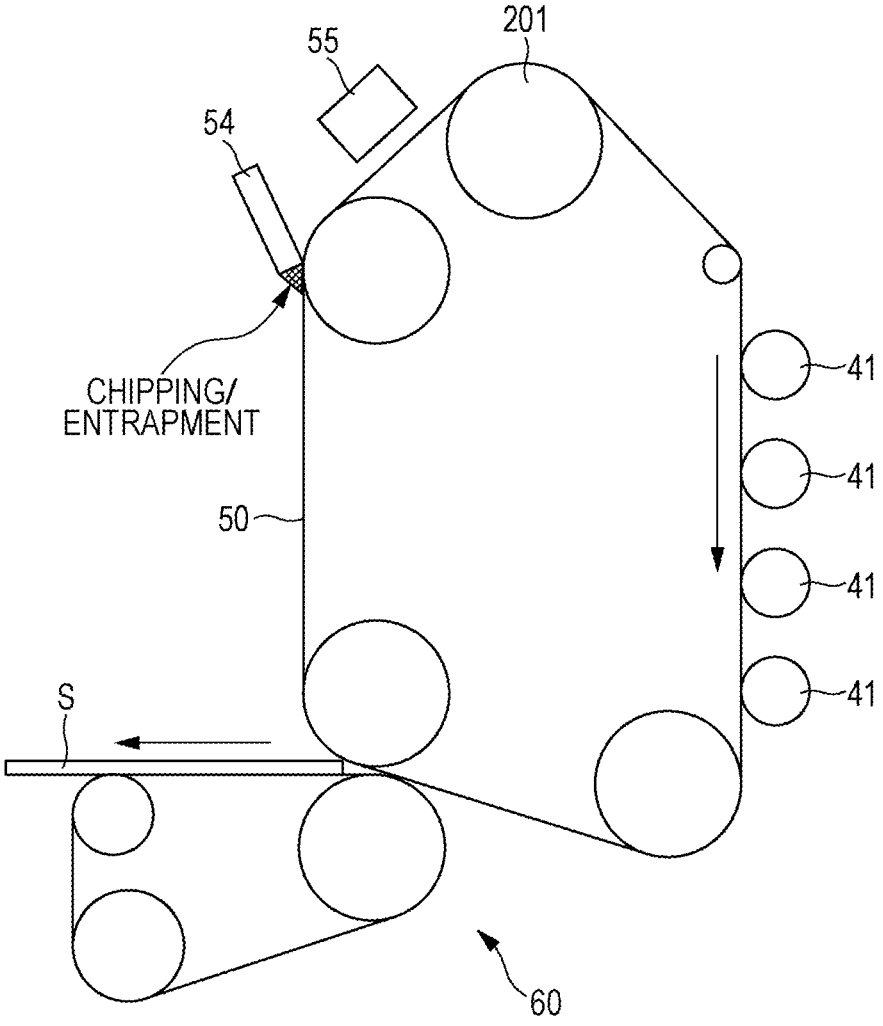
FIG. 2 is a view for illustrating chipping or entrapment of a cleaning blade which causes a streaky stain.

In the cleaning device 53 using the cleaning blade 54, there is a case where the residual material such as the toner slips out due to chipping of the cleaning blade 54 or entrapment of a foreign material as illustrated in FIG. 2. Due to this slip-out, a streaky stain is generated on the surface of the intermediate transfer belt 50 in a moving direction of the intermediate transfer belt 50, that is, in a FD direction (sub scanning direction). Especially in a case of the stain caused by the chipping, the streaky stain is continuously generated unless the cleaning blade 54 is replaced, so that production is stopped until a service person requested to repair arrives and replaces the cleaning member.

Therefore, the image forming apparatus 1 according to this embodiment includes a detector 55 capable of detecting the streaky stain (residual toner image) on the intermediate transfer belt 50 over an entire area in a width direction (main scanning direction) of the intermediate transfer belt 50. The detector 55 is provided in a downstream position of the cleaning blade 54, more specifically, between the cleaning blade 54 and the steering roller 201, in a state of being opposed to the surface of the intermediate transfer belt 50.

In the image forming apparatus 1 according to this embodiment, a relative position between the intermediate transfer belt 50 and the cleaning blade 54 in a direction orthogonal to the FD direction (sub scanning direction) is controlled under the control of a controller 100 (refer to FIG. 6) to be described later on the basis of the information regarding the streaky stain detected by the detector 55. Herein, the "direction orthogonal to the FD direction (sub scanning direction)" includes not only the direction strictly orthogonal but also the direction substantially orthogonal, and various variations in design or in manufacture are acceptable.

As the information regarding the streaky stain, information such as a width of the streaky stain, the number of streaky stains, and an interval between a plurality of stains may be exemplified, but it is not required that all of these pieces of information are included. For example, in a case of one streaky stain, only the information of the width of the streaky stain may be used as the information regarding the streaky stain. That is, the information regarding the streaky stain is at least one of the width of the streaky stain, the number of streaky stains, and the interval between a plurality of stains.

[Adjusting Mechanism of Relative Position Between Intermediate Transfer Belt and Cleaning Blade]

Next, an adjusting mechanism which adjusts the relative position between the intermediate transfer belt 50 and the cleaning blade 54 in the direction (main scanning direction) orthogonal to the FD direction (sub scanning direction) based on the information regarding the streaky stain detected by the detector 55 under the control of the controller 100 (refer to FIG. 6) to be described later is described.

As the adjusting mechanism which adjusts the relative position between the intermediate transfer belt 50 and the cleaning blade 54 in the main scanning direction, there may be a mechanism which moves the intermediate transfer belt 50 with respect to the cleaning blade 54, and a mechanism which moves the cleaning blade 54 with respect to the intermediate transfer belt 50. Hereinafter, a specific configuration of each mechanism is described supposing that the former mechanism is an adjusting mechanism 200 and the latter mechanism is an adjusting mechanism 300. As these adjusting mechanisms 200 and 300, a steering mechanism may be exemplified.

(Adjusting Mechanism which Moves Intermediate Transfer Belt with Respect to Cleaning Blade)

Figure 3:
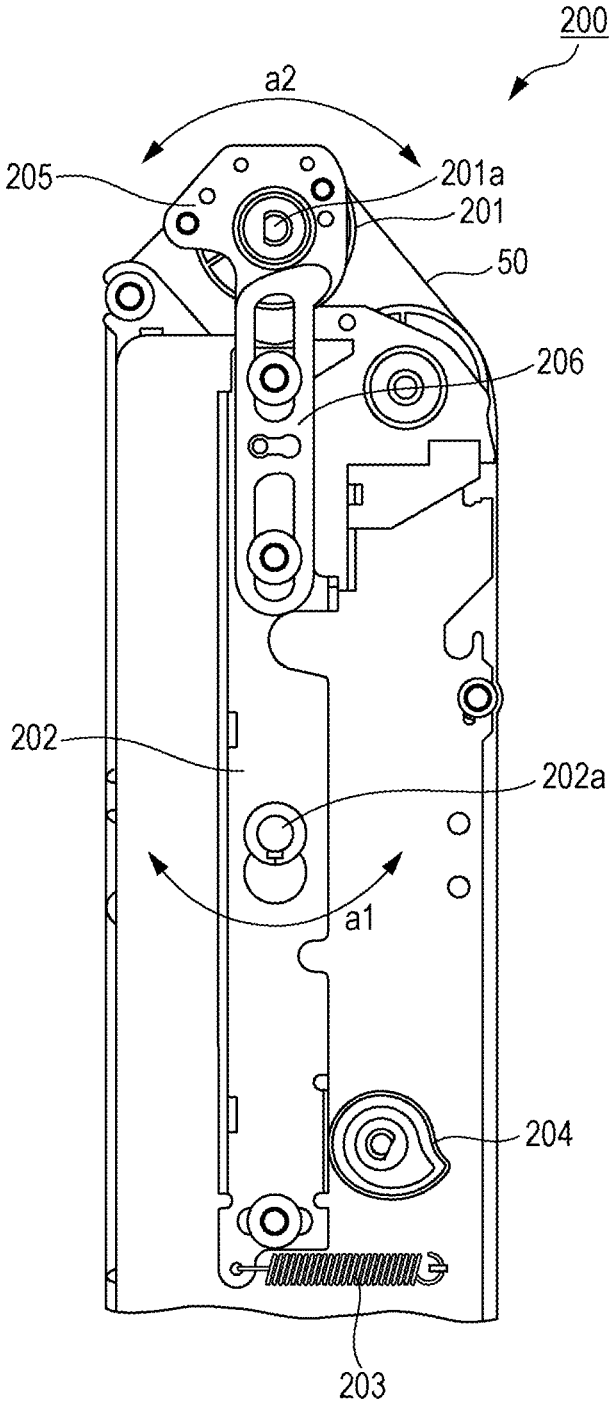
FIG. 3 is a schematic side view illustrating an example of a configuration of an adjusting mechanism which moves an intermediate transfer belt with respect to the cleaning blade.
Figure 4:
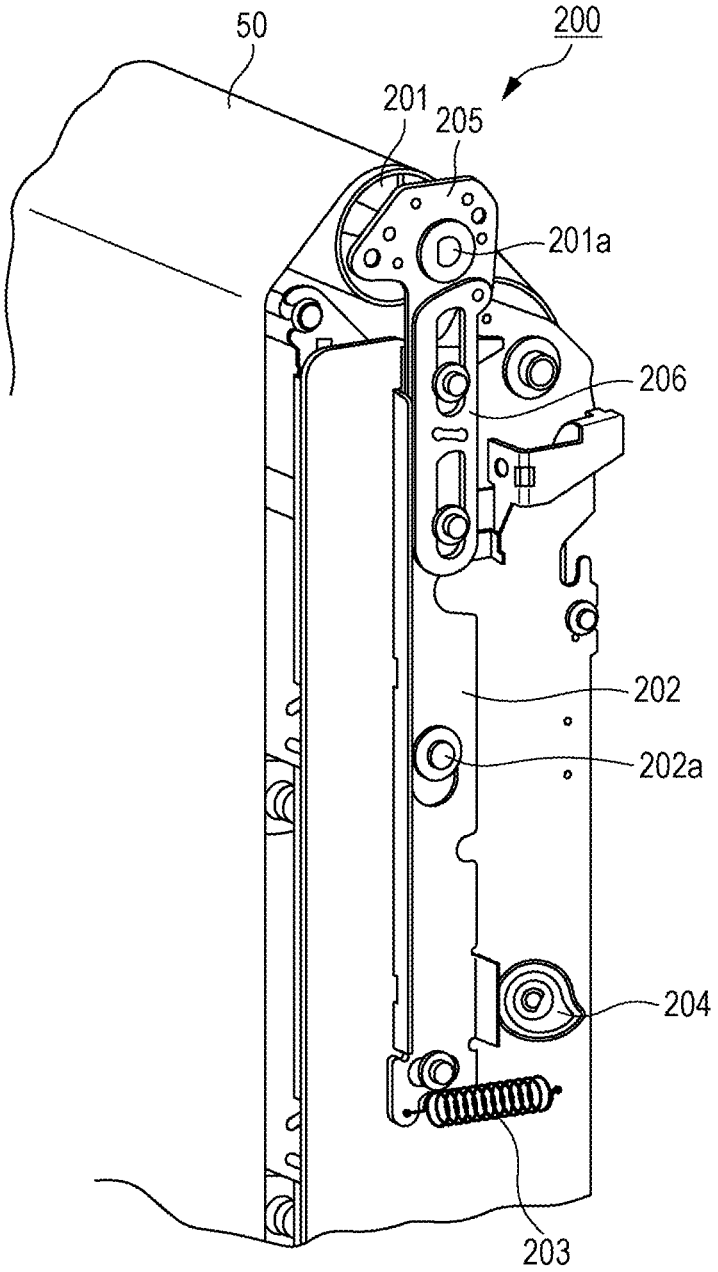
FIG. 4 is a schematic perspective view illustrating an example of the configuration of the adjusting mechanism which moves the intermediate transfer belt with respect to the cleaning blade.

FIG. 3 is a schematic side view illustrating an example of the configuration of the adjusting mechanism 200 which moves the intermediate transfer belt 50 with respect to the cleaning blade 54 and FIG. 4 is a schematic side view illustrating an example of the configuration of the adjusting mechanism 200.

As illustrated in FIGS. 3 and 4, the adjusting mechanism 200 which moves the intermediate transfer belt 50 with respect to the cleaning blade 54 is formed of, for example, a steering mechanism provided with a steering roller 201, an arm 202, a spring member 203, an eccentric cam 204, a supporting unit 205, a connecting unit 206 and the like.

The steering roller 201 is provided so as to abut an inner surface of the intermediate transfer belt 50. In the steering roller 201, one end in an axial direction of a shaft unit 201*a* is supported by the supporting unit 205. The supporting unit 205 is connected to an upper end of the arm 202 via the connecting unit 206. The connecting unit 206 is attached to the arm 202 so as to be slidable in a length direction thereof. The supporting unit 205 is fixed to a tip end of the connecting unit 206.

The connecting unit 206 is biased upward in FIGS. 3 and 4 by a biasing member not illustrated, and as a result, the supporting unit 205 and the steering roller 201 fixed to the connecting unit 206 are biased upward. As a result, the steering roller 201 is pressed against the inner surface of the intermediate transfer belt 50, and as a result, tension is applied to the intermediate transfer belt 50.

The spring member 203 is connected to a lower end of the arm 202. The spring member 203 biases the arm 202 in a direction to approach the eccentric cam 204 rotatably provided in an adjacent position. As a result, the lower end of the arm 202 is pressed against a cam surface of the eccentric cam 204. The eccentric cam 204 rotates by a predetermined rotational amount in a forward direction or a reverse direction under driving by a driving motor 207 illustrated in FIG. 6 in accordance with an instruction of the controller 100 (refer to FIG. 6) to be described later.

When the eccentric cam 204 rotates in the forward direction or the reverse direction by a predetermined rotational amount, the arm 202 in a state of being pressed against the cam surface of the eccentric cam 204 rotates in a direction indicated by arrow a1 illustrated in FIG. 3 around a fulcrum 202*a*. As a result, the connecting unit 206 and the supporting unit 205 connected to the upper end of the arm 202 move, and one end in the axial direction of the steering roller 201 rotates in a direction indicated by arrow a2 illustrated in FIG. 3.

The arm 202, the spring member 203, the eccentric cam 204, the supporting unit 205, the connecting unit 206 and the like are not provided on the other end (end in the back of a paper surface of FIG. 3) in the axial direction of the steering roller 201. As a result, inclination of the steering roller 201 is changeable with the other end in the axial direction as a fulcrum.

Figure 6:
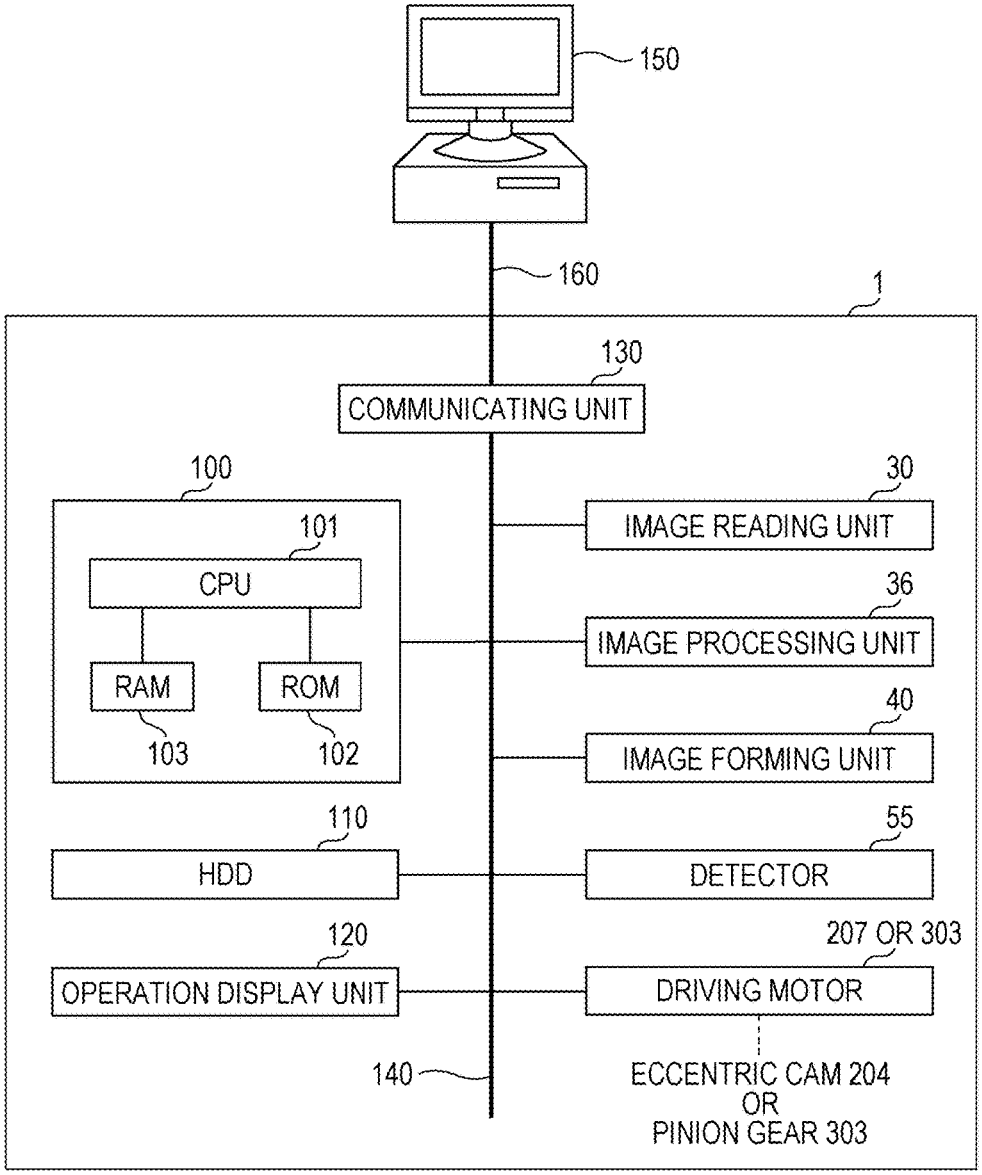
FIG. 6 is a block diagram illustrating an example of a hardware configuration of each unit of the image forming apparatus according to one embodiment of the present invention.

The adjusting mechanism 200 having the above-described configuration may rotate the eccentric cam 204 in the forward direction or the reverse direction under the driving by the driving motor 207 illustrated in FIG. 6 according to the instruction of the controller 100, thereby adjusting the position of the intermediate transfer belt 50 with respect to the cleaning blade 54 in the main scanning direction (the direction orthogonal to the FD direction). More specifically, to the controller 100 may rotate the eccentric cam 204 to move the upper end of the arm 202 based on the information regarding the streaky stain detected by the detector 55, thereby controlling the relative position between the intermediate transfer belt 50 and the cleaning blade 54 in the main scanning direction.

The adjusting mechanism 200 having the above-described configuration formed of the steering mechanism may also be used for correcting a shift in the width direction of the rotational position of the intermediate transfer belt 50. However, when adjusting the relative position between the intermediate transfer belt 50 and the cleaning blade 54 in the main scanning direction during operation of bringing the intermediate transfer belt 50 in one direction (steering) by the adjusting mechanism 200, it is preferable to move the intermediate transfer belt 50 in the moving direction conforming to a steering direction. As a result, it is possible to prevent a problem such as break of the intermediate transfer belt 50 due to an excessive shift of the intermediate transfer belt 50 from occurring.

(Adjusting Mechanism which Moves Cleaning Blade with Respect to Intermediate Transfer Belt)

Figure 5:
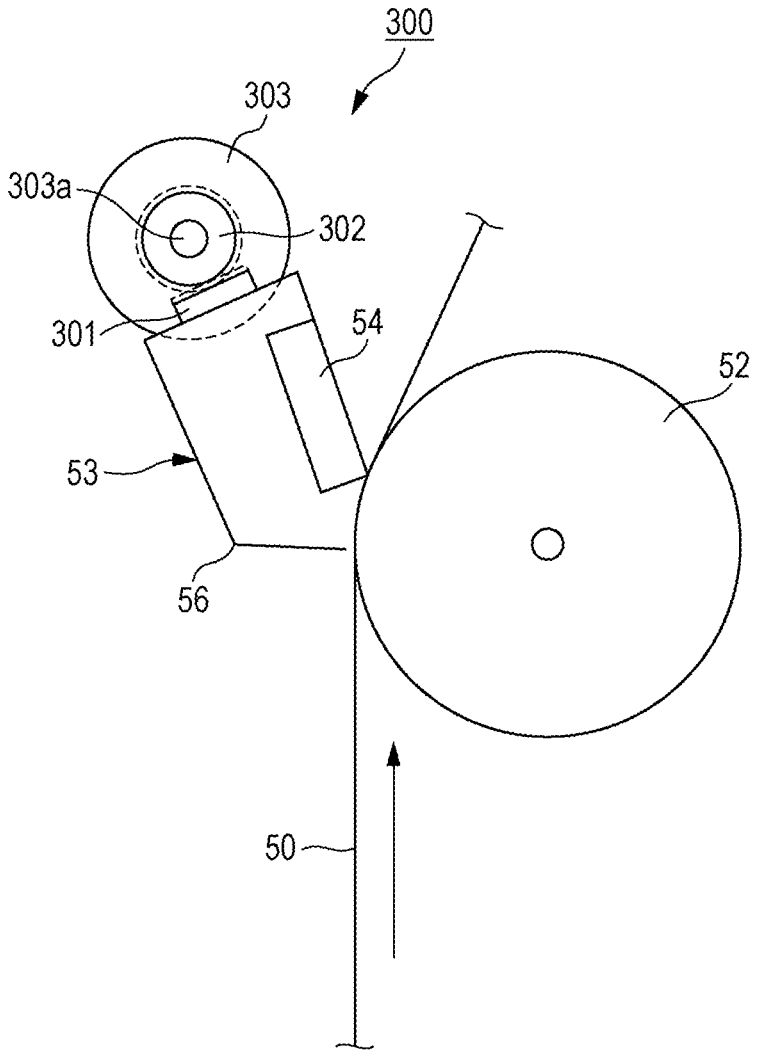
FIG. 5 is a schematic side view illustrating an example of a configuration of an adjusting mechanism which moves the cleaning blade with respect to the intermediate transfer belt.

FIG. 5 is a schematic side view illustrating an example of the configuration of the adjusting mechanism 300 which moves the cleaning blade 54 with respect to the intermediate transfer belt 50.

As illustrated in FIG. 5, the adjusting mechanism 300 which moves the cleaning blade 54 with respect to the intermediate transfer belt 50 is formed of, for example, a steering mechanism provided with a rack gear 301, a pinion gear 302, a driving motor 303 and the like.

The rack gear 301 is attached to a cleaning device case 56 to which the cleaning blade 54 is attached. The pinion gear 302 is attached to a rotation shaft 303*a* of a driving motor 303 in a state of meshing with the rack gear 301. The driving motor 303 rotates the pinion gear 302 in the forward direction or the reverse direction under the control of the controller 100 to be described later.

The adjusting mechanism 300 configured as described above may rotate the pinion gear 302 in the forward direction or the reverse direction under the driving by the driving motor 303 in accordance with the instruction of the controller 100, thereby adjusting the position of the cleaning blade 54 with respect to the intermediate transfer belt 50 in the main scanning direction (the direction orthogonal to the FD direction). More specifically, the controller 100 may rotate the pinion gear 302 to move the rack gear 301 based on the information regarding the streaky stain detected by the detector 55, thereby controlling the relative position between the intermediate transfer belt 50 and the cleaning blade 54 in the main scanning direction.

[Configuration of Control System of Image Forming Apparatus]

A configuration of a control system of the image forming apparatus 1 is next described with reference to FIG. 6. FIG. 6 is a block diagram illustrating the configuration of the control system of the image forming apparatus 1.

As illustrated in FIG. 6, the image forming apparatus 1 includes the controller 100. The controller 100 is formed on the control substrate 90 illustrated in FIG. 1.

The controller 100 includes a central processing unit (CPU) 101, a read only memory (ROM) 102 for storing a program and the like executed by the CPU 101, and a random access memory (RAM) 103 used as a working area of the CPU 101, for example. Meanwhile, an electrically erasable programmable ROM may be used, for example, as the ROM 102.

The controller 100 is connected to the image reading unit 30, the image processing unit 36, the image forming unit 40, the detector 55, the driving motor 207 (or 303), a hard disk drive (HDD) 110, an operation display unit 120, and a communicating unit 130 via a system bus 140 to control an entire image forming apparatus 1.

Specifically, the controller 100 drives and controls the image forming unit 40 to form a toner image for image density control or a toner image for image forming, and primarily transfers the same to the intermediate transfer belt 50. The controller 100 also drives and controls the secondary transfer unit 60 illustrated in FIG. 1 to secondarily transfer the toner image carried by the intermediate transfer belt 50 to the paper S. Furthermore, the controller 100 drives and controls the fixing unit 80 illustrated in FIG. 1, and pressurizes and heats the paper S to fix the toner image to the paper S.

The HDD 110 stores the image data of the document image obtained by reading by the image reading unit 30 or stores the already output image data and the like. The operation display unit 120 is a touch panel formed of a display such as a liquid crystal display (LCD) or an organic electro luminescence (EL) display device. The operation display unit 120 displays an instruction menu for the user, information regarding the obtained image data and the like. Furthermore, the operation display unit 120 provided with a plurality of keys serves as an input unit which accepts an input of various instructions, and data such as characters and numbers by key operation of the user.

The communicating unit 130 receives job information transmitted from a personal computer (PC) 150 being an example of the external device via a communication line 160 and transmits the received job information to the controller 100 via the system bus 140. The job information includes image data of an image to be formed and information such as a type of paper and the number of sheets of paper to be used associated with the image data.

Meanwhile, although an example in which the PC 150 is applied as the external device is described in this embodiment, the present invention is not limited to this, and various other devices such as a facsimile device may be applied, for example, as the external device.

The image reading unit 30 optically reads the document image and converts the same to an electric signal. For example, when reading a color document, image data having luminance information of 10-bit gradation for each of RGB per pixel is generated. The image data generated by the image reading unit 30 and the image data transmitted from the PC 150 which is an example of the external device connected to the image forming apparatus 1 are sent to the image processing unit 36.

The image processing unit 36 performs image processing such as shading correction, image density adjustment, and image compression on the received image data as necessary. The image forming unit 40 receives the image data subjected to the image processing by the image processing unit 36 and forms an image on the paper S based on the image data.

The detector 55 detects the streaky stain generated on the surface of the intermediate transfer belt 50 in the moving direction of the surface of the intermediate transfer belt 50. More specifically, the detector 55 detects the information such as the width of the streaky stain, the number of the stains, the interval between a plurality of stains as the information regarding the streaky stain.

The driving motor 207 (or 303) is a driving source of the adjusting mechanism which adjusts the relative position between the intermediate transfer belt 50 and the cleaning blade 54 in the direction (main scanning direction) orthogonal to the FD direction (sub scanning direction) under the control of the controller 100 based on a detection result of the detector 55. That is, in the adjusting mechanism 200 illustrated in FIGS. 3 and 4, the driving motor 207 drives the eccentric cam 204, thereby adjusting the position of the intermediate transfer belt 50 in the main scanning direction. In the adjusting mechanism 300 illustrated in FIG. 5, the driving motor 303 drives the pinion gear 302, thereby adjusting the position of the cleaning blade 54 in the main scanning direction.

Specific examples for detecting the streaky stain by the detector 55 and controlling the relative position between the intermediate transfer belt 50 and the cleaning blade 54 in the main scanning direction under the control of the controller 100 based on the detection result will be hereinafter described.

First Example

Figure 7:
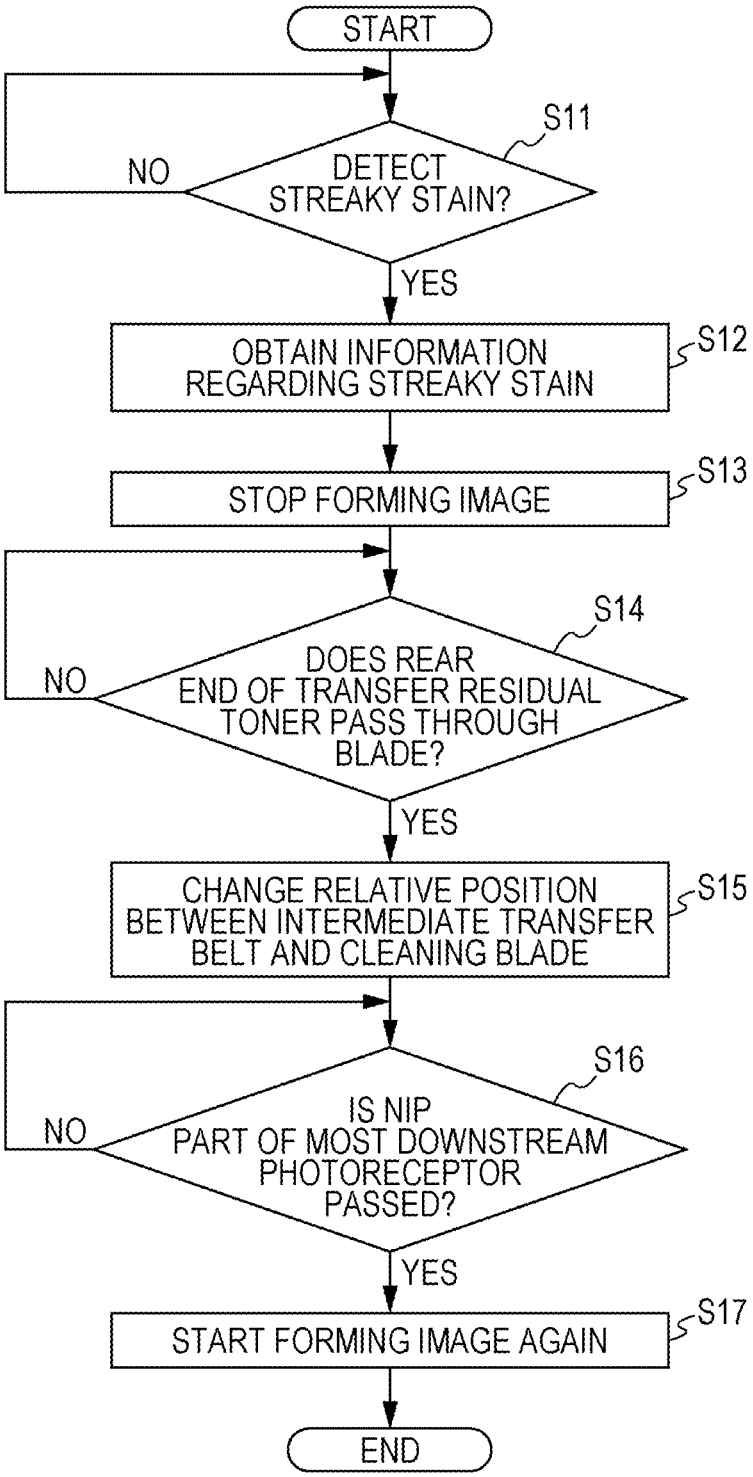
FIG. 7 is a flowchart illustrating an example of a flow of basic control according to a first example.

A first example is a basic configuration example of controlling the relative position between the intermediate transfer belt 50 and the cleaning blade 54 in the main scanning direction. FIG. 7 is a flowchart illustrating an example of a flow of a basic process according to the first example. This basic process is executed under the control of the controller 100.

The controller 100 first determines whether the detector 55 detects the streaky stain by the residual toner and the like on the intermediate transfer belt 50 (step S11), and when detecting the streaky stain (YES at S11), this obtains the information regarding the streaky stain based on the detection result (step S12). Examples of the information regarding the streaky stain include the width of the streaky stain, the number of the stains, the interval between a plurality of stains and the like.

Next, the controller 100 stops forming an image by separating the photoreceptor 41 and the secondary transfer unit 60 from the intermediate transfer belt 50 at timing when the detector 55 detects the streaky stain (step S13). Next, the controller 100 determines whether a rear end position of the residual toner image after the transfer to the intermediate transfer belt 50 (hereinafter referred to as a "transfer residual toner image") passes through the cleaning blade 54 (step S14).

Next, the controller 100 changes the relative position between the intermediate transfer belt 50 and the cleaning blade 54 in the direction orthogonal to the FD direction based on the information regarding the streaky stain obtained at step S12 (step S15). At that time, the relative position between the intermediate transfer belt 50 and the cleaning blade 54 is adjusted such that a control amount (movement amount) is not smaller than the width of the streaky stain and does not coincide with the interval between the plurality of stains. This relative position adjustment may be executed under the driving of the adjusting mechanism 200 or the adjusting mechanism 300 or both of them.

The controller 100 next determines whether a rear end position of the streaky stain on the intermediate transfer belt 50 passes through the nip part of the most downstream photoreceptor 41 (in this example, the photoreceptor 41 of the image forming unit 40K) (step S16). That is, a period from timing when the rear end position of the transfer residual toner image on the intermediate transfer belt 50 passes through the cleaning blade 54 to timing when the rear end position of the streaky stain passes through the nip part of the most downstream photoreceptor 41 is set as a paper interval in which the relative position between the intermediate transfer belt 50 and the cleaning blade 54 is controlled.

Herein, the rear end position of the transfer residual toner image and the rear end position of the streaky stain may be obtained from, for example, the information of the image to be formed, a moving speed of the intermediate transfer belt 50 and the like. The "paper interval" is intended to mean an area between images formed on the intermediate transfer belt 50 in units to of paper S.

Next, when determining that the rear end position of the streaky stain passes through the nip part of the most downstream photoreceptor 41, the controller 100 starts forming an image again (step S17), and ends a series of processes for controlling the relative position between the intermediate transfer belt 50 and the cleaning blade 54 in the main scanning direction.

As described above, by controlling the relative position between the intermediate transfer belt 50 and the cleaning blade 54 based on the information regarding the streaky stain, a position in the direction orthogonal to the FD direction of a slip-out portion of the cleaning blade 54 in which the stain slips out in a streak shape. Then, in an area of the stain generated in a streak shape, a portion other than the slip-out portion of the cleaning blade 54 is located. As a result, it is possible to surely clean the streaky stain by the portion other than the slip-out portion of the cleaning blade 54.

When the detector 55 detects the streaky stain by the residual toner and the like on the intermediate transfer belt 50, this may notify the user that a trouble such as the chipping of the cleaning blade 54 or the entrapment of the foreign material occurs by displaying the detection result on, for example, the operation display unit 120 (refer to FIG. 6). In response to this notice, the user requests the service person to repair.

Herein, when quality deterioration of an output image due to the streaky stain continuously occurs, after detection of the quality deterioration, production stops until the service person requested to repair arrives and replaces the cleaning blade 54. In contrast, when the streaky stain is detected, it is possible to eliminate the streaky stain by controlling the relative position between the intermediate transfer belt 50 and the cleaning blade 54, so that it is possible to continue printing without stopping the production until the service person arrives and the cleaning blade 54 is replaced.

Meanwhile, if the streaky stain is generated by slip-out of the residual material due to the chipping of the cleaning blade 54, it is necessary to contact the service person to replace the cleaning blade 54 when the detector 55 detects the streaky stain. In contrast, if the streaky stain is generated by the slip-out of the residual material due to the entrapment of the foreign material, the entrapment of the foreign material might be eliminated by continuing printing. Accordingly, instead of notifying of the generation of the stain when the detector 55 detects the streaky stain for the first time, it is possible to adopt a mode of notifying of the generation of the stain when the detector 55 detects the same a predetermined number of times.

Figure 8A:
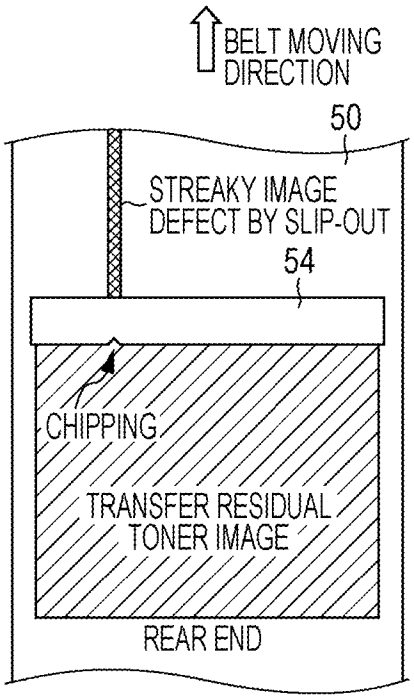
FIGS. 8A to 8C are views schematically illustrating images of cleaning by relative position control between the intermediate transfer belt and the cleaning blade.
Figure 8B:
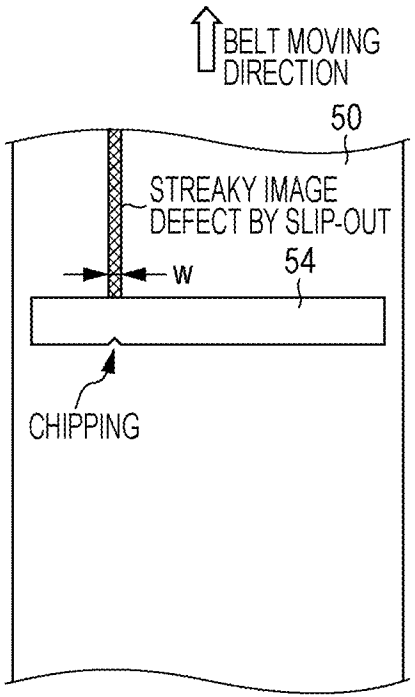
Figure 8C:
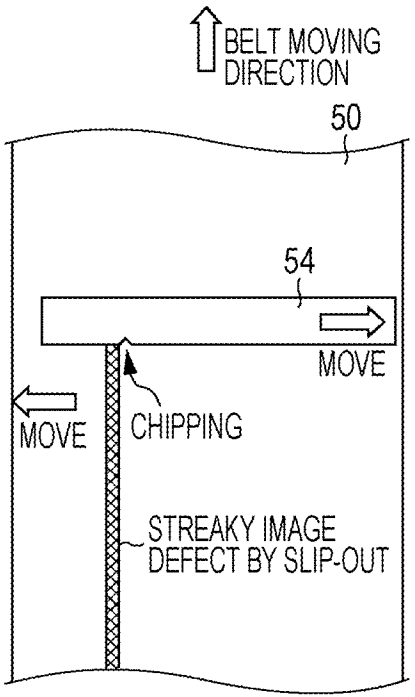

FIGS. 8A to 8C schematically illustrate images of cleaning by relative position control between the intermediate transfer belt 50 and the cleaning blade 54. A case where the streaky stain is generated on the surface of the intermediate transfer belt 50 by the slip-out due to the chipping of the cleaning blade 54 is herein described as an example.

FIG. 8A illustrates a state in which, for example, one residual toner image is generated as the stain in the streak shape on the surface of the intermediate transfer belt 50. The toner after the transfer remains (transfer residual toner image) upstream of the cleaning blade 54 of the intermediate transfer belt 50, and the cleaning blade 54 removes the residual toner after the transfer, thereby cleaning the surface of the intermediate transfer belt 50. However, the streaky residual toner image is generated by the slip-out due to the chipping of the cleaning blade 54.

FIG. 8B illustrates a state in which the rear end position of the transfer residual toner image passes through the cleaning blade 54. In this state, the streaky residual toner image is generated as the stain downstream of the cleaning blade 54 of the intermediate transfer belt 50. FIG. 8C illustrates a state after the relative position between the intermediate transfer belt 50 and the cleaning blade 54 is changed.

In a case of this example, the stain is one residual toner image. Therefore, the detector 55 detects information of a width w of one residual toner image as the information regarding the stain. Then, the controller 100 calculates a control amount (movement amount) not smaller than the width w based on the information of the width w of the streaky residual toner image, and changes (controls) the relative position between the intermediate transfer belt 50 and the cleaning blade 54.

As is clear from FIG. 8C, the portion other than the slip-out portion due to the chipping of the cleaning blade 54 is located in the area of the residual toner image generated in a streak shape by changing the relative position with the control amount not smaller than the width of the streaky residual toner image. As a result, it is possible to surely clean the streaky residual toner image by the portion other than the slip-out portion of the cleaning blade 54.

Meanwhile, since the relative position is controlled from the timing when the rear end position of the transfer residual toner image on the intermediate transfer belt 50 passes through the cleaning blade 54, no new stain is generated by the slip-out due to the chipping of the cleaning blade 54 after the relative position is changed.

Figure 9:
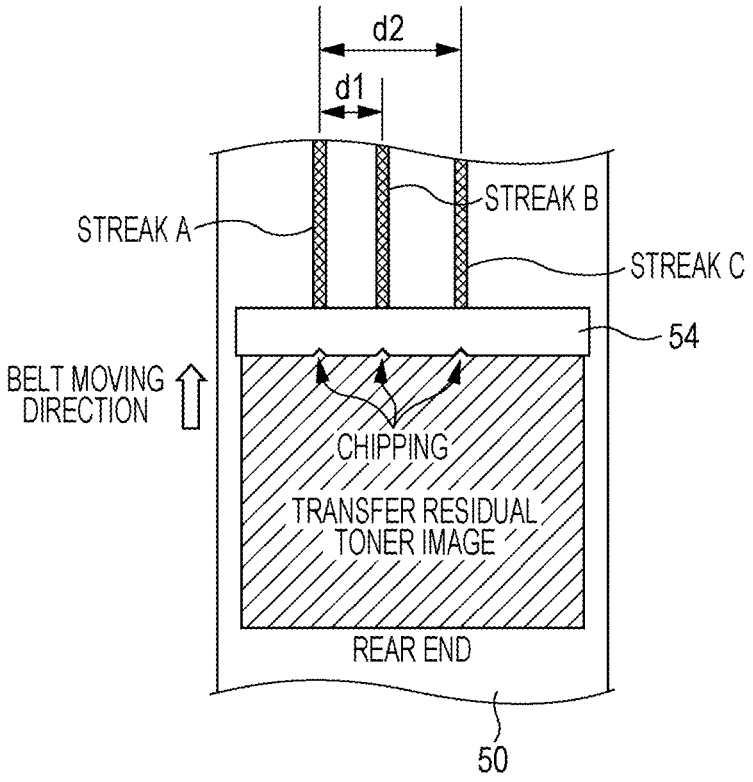
FIG. 9 is a view for illustrating information regarding the stain obtained in a case of a plurality of streaky stains.

Although a case where one streaky residual toner image is generated as the stain is taken as an example in the above-described example, there also is a case where three streaky residual toner images are generated, for example, as the stains as illustrated in FIG. 9. In this case, information of the number n of the streaky residual toner images and the interval (distance) d between the plurality of residual toner images is obtained as the information regarding the stain by the detector 55.

Specifically, in FIG. 9, when three streaky residual toner images are referred to as a streak A, a streak B, and a streak C from the left of the drawing for convenience, the information regarding the stain is obtained such as the number n of stains=3, an interval d1 between the stains A and B=○○ mm, and an interval d2 between the stains A and C=ΔΔ mm. Then, the controller 100 calculates the movement amount based on the obtained information such that the chipping portion of the cleaning blade 54 is not located in the area of the residual toner image, and changes the relative position between the intermediate transfer belt 50 and the cleaning blade 54.

(First Control Example)

Changing the relative position between the intermediate transfer belt 50 and the cleaning blade 54 promotes the chipping of the cleaning blade 54, abrasion of the cleaning blade 54 and the like. Therefore, it is preferable to set a requisite minimum movement amount as the control amount when controlling the relative position between the intermediate transfer belt 50 and the cleaning blade 54. Herein, the "requisite minimum movement amount" is intended to mean the minimum movement amount within a range in which a portion which causes the streaky stain of the cleaning blade 54 (for example, the chipping portion) is not located in the area of the residual toner image.

Figure 10:
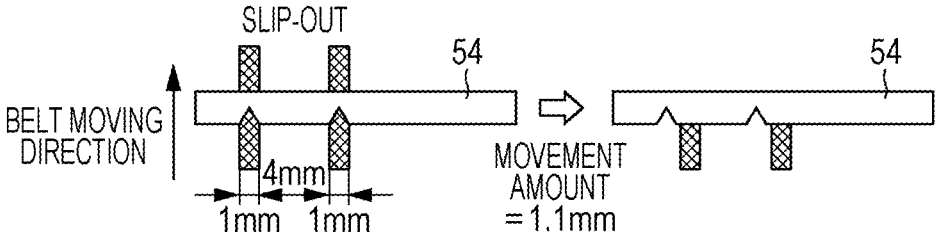
FIG. 10 is an illustrative diagram of a change amount of a relative position between the intermediate transfer belt and the cleaning blade.

One specific example is illustrated in FIG. 10. In this specific example, a case where there are two residual toner images which are the streaky stains, the width w of the residual toner image is 1 mm, and the interval d between the two residual toner images is 4 mm is illustrated. In a case of this specific example, it is preferable to set a change amount to be the minimum value of 1.1 mm in the range in which the chipping portion is not located in the area of the residual toner image. It is possible to continue producing (printing) while minimizing a damage of the cleaning blade 54 by setting the control amount (movement amount) of the relative position between the intermediate transfer belt 50 and the cleaning blade 54 so as to be minimum within the range in which the chipping portion is not located in the area of the residual toner image in this manner.

(Second Control Example)

It is also possible to control to set the moving speed (driving speed) of the intermediate transfer belt 50 to be higher than that in normal printing in the paper interval in which the relative position between the intermediate transfer belt 50 and the cleaning blade 54 is controlled. As a result, it is possible to shorten downtime as the paper interval, so that a decrease in productivity may be suppressed.

For example, in order to realize the control of the present invention in a driving unit of the intermediate transfer belt 50 (the length of the intermediate transfer belt 50=1000 mm), the belt driving at 460 mm/second in normal printing, extra driving by at least one lap of the intermediate transfer belt 50 is required, so that it is necessary to add the paper interval of a little longer than two seconds. Therefore, by setting the speed to, for example, 690 mm/second only during the paper interval, the downtime may be shortened by approximately 0.7 second, so that the decrease in productivity may be suppressed.

(Control Example 3)

It is also possible to control to increase (strengthen) abutting pressure of the cleaning blade 54 to the surface of the intermediate transfer belt 50 in such a manner as to increase a biting amount, for example, at timing when the relative position between the intermediate transfer belt 50 and the cleaning blade 54 is controlled.

As timing where it is required to control the relative position between the intermediate transfer belt 50 and the cleaning blade 54, it is assumed a state in which the cleaning blade 54 is deteriorated to some extent, for example, such as at the end of endurance, for example. Therefore, at the timing when (place where) the relative position between the intermediate transfer belt 50 and the cleaning blade 54 is changed, the abutting pressure of the cleaning blade 54 to the surface of the intermediate transfer belt 50 is increased. As a result, the streaky residual toner image may be surely cleaned.

It is also possible to operate in a state in which the abutting pressure is increased without returning the abutting pressure once increased to original abutting pressure. As a result, it is possible to improve a cleaning performance for minute slip-out caused by an increase in a wear width of the cleaning blade 54 at the end of endurance, so that it is possible to decrease an occurrence rate of image defects until the cleaning blade 54 is replaced.

Second Example

A second example is a specific example of the configuration of the detector 55 which obtains the information regarding the streaky stain. Hereinafter, the detector 55 will be specifically described taking two configuration examples as examples as first and second configuration examples.

(First Configuration Example)

Figure 11:
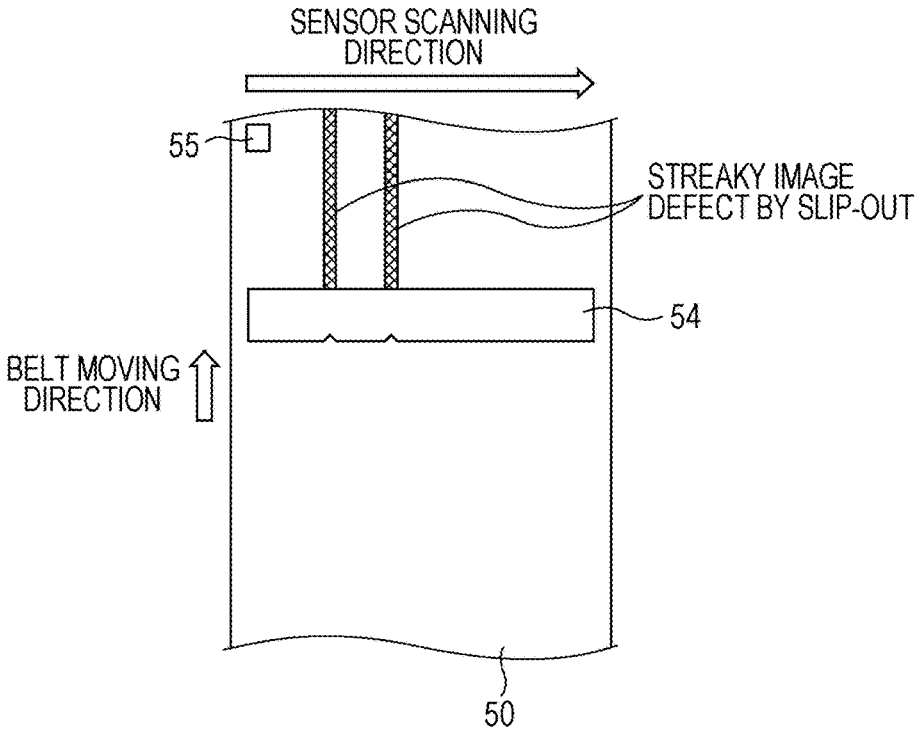
FIG. 11 is an illustrative diagram of a detector according to a first configuration example of a second example.

FIG. 11 is an illustrative diagram of the detector 55 according to the first configuration example of the second example. As illustrated in FIG. 11, the detector 55 according to the first configuration example is formed of, for example, one reflecting-type detecting sensor (optical sensor)

arranged so as to be opposed to the intermediate transfer belt 50 downstream of the cleaning blade 54, and this is configured to be attached to a moving mechanism not illustrated, to scan the surface of the intermediate transfer belt 50 in the direction (main scanning direction) orthogonal to the FD direction.

The detector 55 according to first configuration example detects (obtains) the information regarding the stain by continuously scanning always in the main scanning direction while the intermediate transfer belt 50 drives. Specifically, when an output value of the detecting sensor exceeds a predetermined threshold, the detector 55 according to the first configuration example detects the information regarding the streaky stain. Setting of the predetermined threshold will be described later.

Meanwhile, although one detecting sensor is used as the detector 55 in this first configuration example, it is also possible to arrange a plurality of optical sensors in the main scanning direction and divides a scanning range to the respective detecting sensors. By dividing the scanning range to a plurality of detecting sensors in this manner, it is possible to improve detection accuracy of the information regarding the stain. As the detecting sensor, a well-known optical sensor may be used.

(Second Configuration Example)

Figure 12:
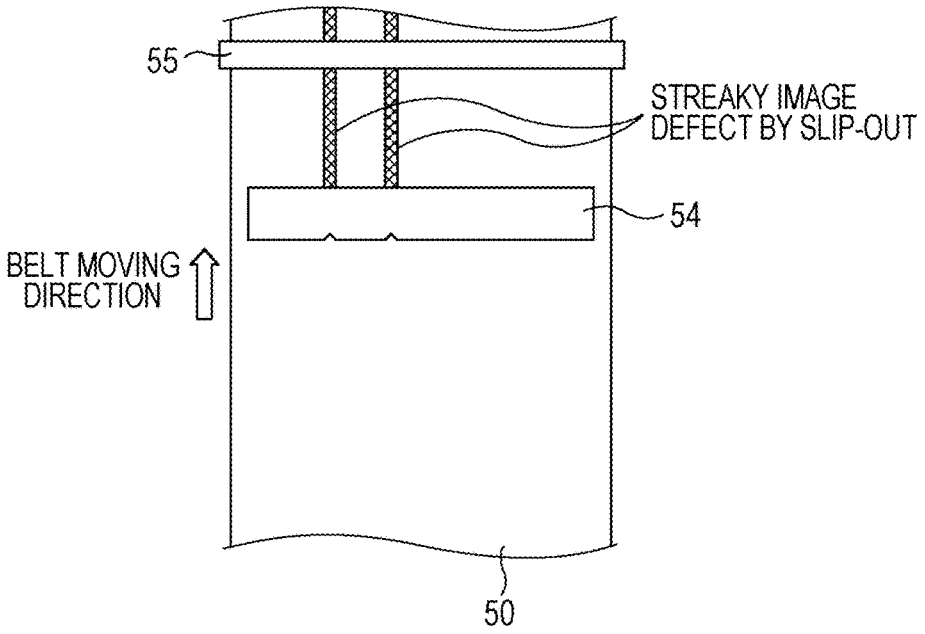
FIG. 12 is an illustrative diagram of a detector according to a second configuration example of the second example.

FIG. 12 is an illustrative diagram of the detector 55 according to the second configuration example of the second example. As illustrated in FIG. 12, the detector 55 according to the second configuration example is formed of a line sensor in which a plurality of detecting sensors is arranged so as to be opposed to the intermediate transfer belt 50 in a line shape in the main scanning direction downstream of the cleaning blade 54. When an output value of each detecting sensor exceeds a predetermined threshold, the detector 55 according to the second configuration example detects the information regarding the streaky stain.

Meanwhile, although the detector 55 of the first and second configuration examples according to the second example detects the information regarding the streaky stain on the intermediate transfer belt 50, this is not limited thereto. For example, it is also possible to detect the streaky stain on the output image by detecting by the detection by the detector 55 at a post-processing step on the output image.

Figure 13:
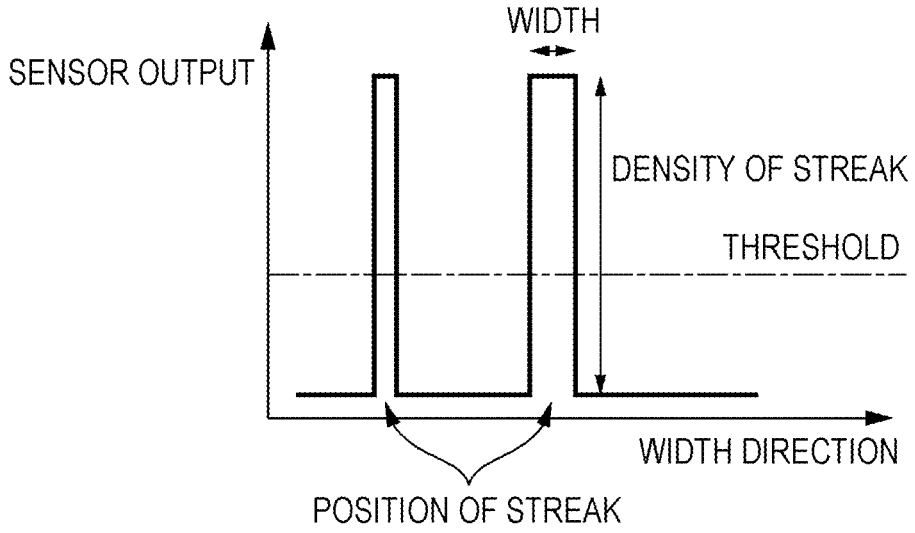
FIG. 13 is an illustrative diagram of setting of a predetermined threshold with respect to an output of a scanning type detecting sensor.

The setting of a predetermined threshold for detecting the information regarding the stain in a case of the detector 55 according to the first configuration example formed of the scanning type detecting sensor is herein described. When detecting the information regarding the streaky stain on the intermediate transfer belt 50, as illustrated in FIG. 13, from information such as density of recognizable streaky stain (sensor output) and a stain width, a predetermined threshold is set in advance as a first threshold for the sensor output. In a case where the output value of the detecting sensor exceeds the first threshold, the presence of the streaky stain is detected, and the relative position between the intermediate transfer belt 50 and the cleaning blade 54 is controlled. It is possible to suppress the decrease in productivity by controlling the relative position between the intermediate transfer belt 50 and the cleaning blade 54 only in a case where it is assumed that a problem occurs on an actual image in this manner.

Third Example

A third example is an example of the image forming apparatus provided with a waste toner reservoir which reserves waste toner. An example of a configuration around the waste toner reservoir is illustrated in FIG. 14.

Figure 14:
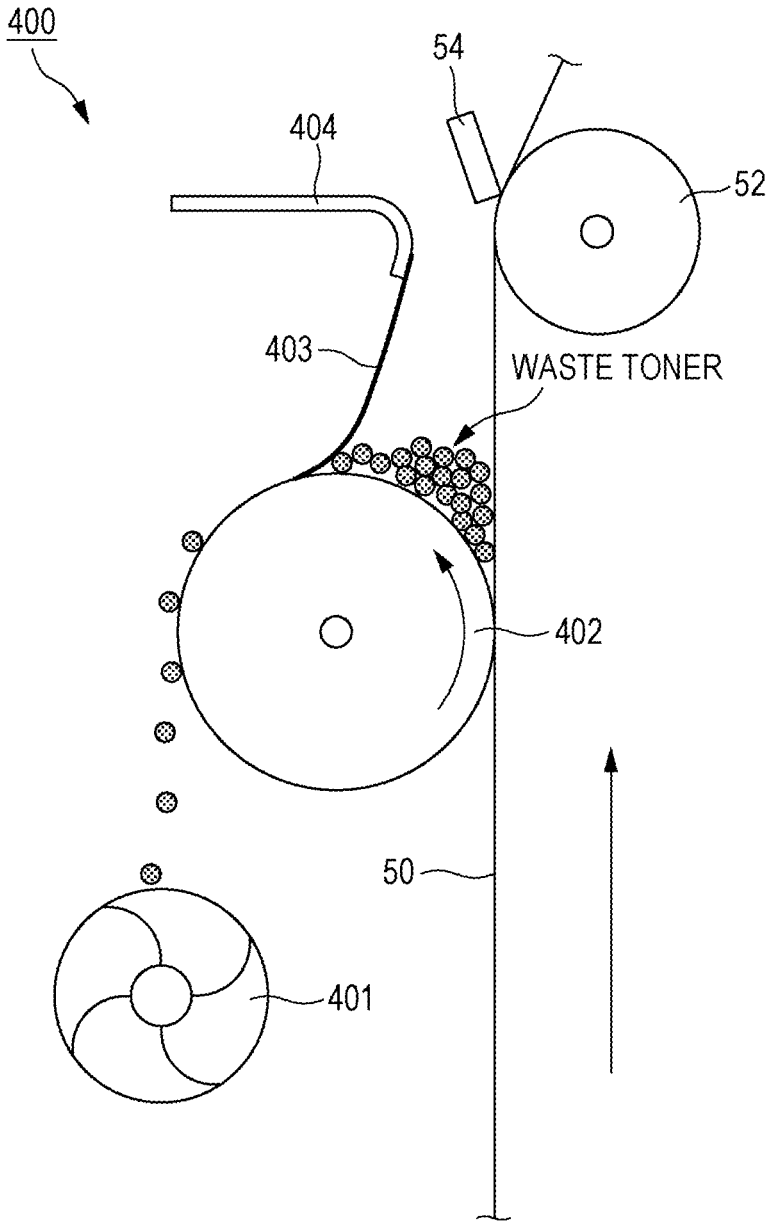
FIG. 14 is a schematic diagram illustrating an example of a configuration around a waste toner reservoir.

As illustrated in FIG. 14, a waste toner reservoir 400 is provided upstream of the cleaning blade 54 of the intermediate transfer belt 50. The waste toner reservoir 400 includes a waste toner screw 401, a toner reserving roller 402, reserving PET 403, and a reserving PET supporting sheet metal 404. One end of the reserving PET 403 is supported by the reserving PET support sheet metal 404 and the other end thereof abuts the toner reserving roller 402, thereby reserving the waste toner upstream of the cleaning blade 54.

In the image forming apparatus 1 provided with this type of waste toner reservoir 400, it is preferable to perform control after discharging all the waste toner when controlling the relative position between the intermediate transfer belt 50 and the cleaning blade 54 under the control of the controller 100 (refer to FIG. 6). By doing so, it is possible to suppress occurrence of slip-out of the waste toner due to the chipping of the cleaning blade 54 and the like.

The discharge of the waste toner may be realized, for example, by separating the other end of the reserving PET 403 from the toner reserving roller 402 under driving by a driving unit not illustrated, and increasing rotational speeds of the toner reserving roller 402 and the waste toner screw 401. In a mode of controlling the relative position between the intermediate transfer belt 50 and the cleaning blade 54, the other end of the reserving PET 403 is always separated from the toner reserving roller 402, so that the waste toner is not reserved in the waste toner reservoir 400 thereafter.

Fourth Example

Figure 15:
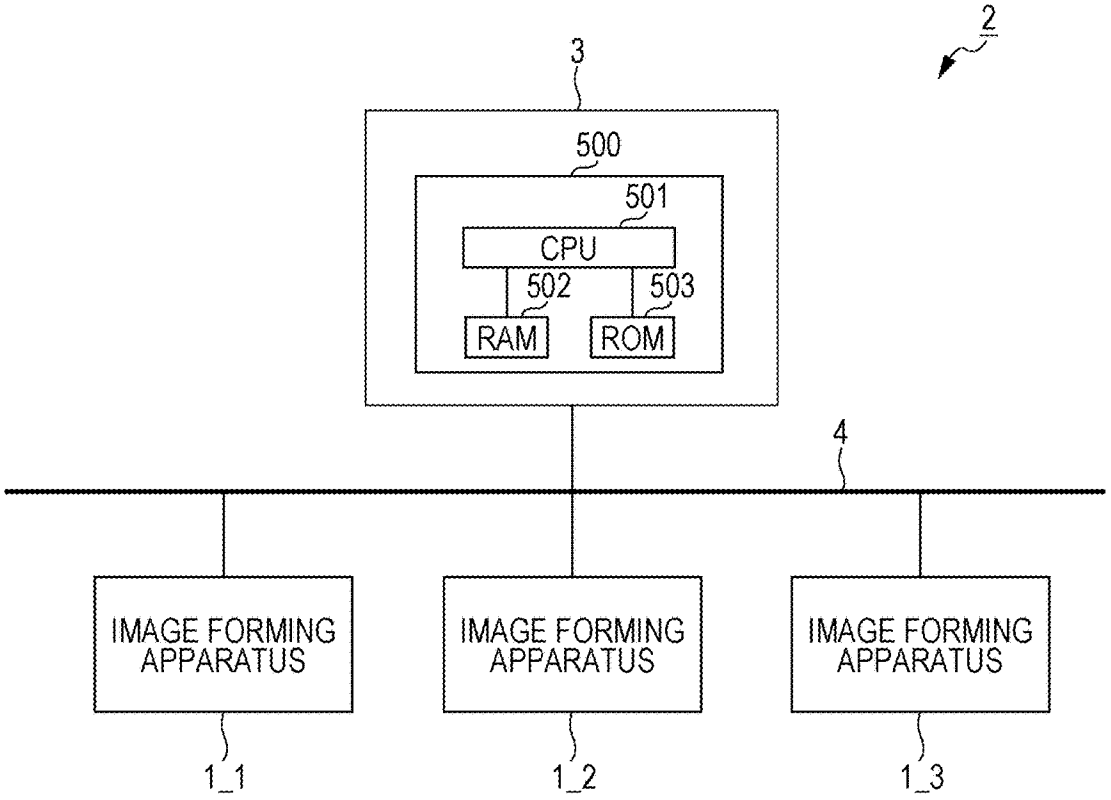
FIG. 15 is a block diagram schematically illustrating a configuration of an image forming system according to an embodiment of the present invention.

A fourth example is an example of an image forming system in which a plurality of image forming apparatuses 1 according to this embodiment is connected via a network. FIG. 15 is a block diagram schematically illustrating a configuration of the image forming system according to the present invention.

This image forming system has a configuration in which a plurality of, for example, three image forming apparatuses 1_1, 1_2, and 1_3 and one server 3 are connected via a network 4. Herein, a connection mode of the image forming apparatuses 1_1, 1_2, and 1_3 and the server 3 to the network 4 is not especially limited, this may be wired connection or wireless connection.

As in the image forming apparatus 1 according to the above-described embodiment, each of the three image forming apparatuses 1_1, 1_2, and 1_3 includes the cleaning device 53 including the cleaning blade 54. Each of the image forming apparatuses 1_1, 1_2, and 1_3 includes the detector 55 which detects that the streaky stain generated on the surface of the intermediate transfer belt 50 exceeds the first threshold, and is configured such that the relative position between the intermediate transfer belt 50 and the cleaning blade 54 is controlled based on the detection result of the detector 55.

The server 3 includes a controller 500 formed of a well-known microcomputer including, for example, a CPU 501, a ROM 502 which stores a program and the like to be executed by the CPU 501, and a RAM 503 used as a working area of the CPU, and integrally manages the three image forming apparatuses 1_1, 1_2, and 1_3 under the control of the controller 500. Especially, the server 3 monitors the generation of the streaky stain for each of the three image forming apparatuses 1_1, 1_2, and 1_3, and controls the relative position between the intermediate transfer belt 50 and the cleaning blade 54.

Figure 16:
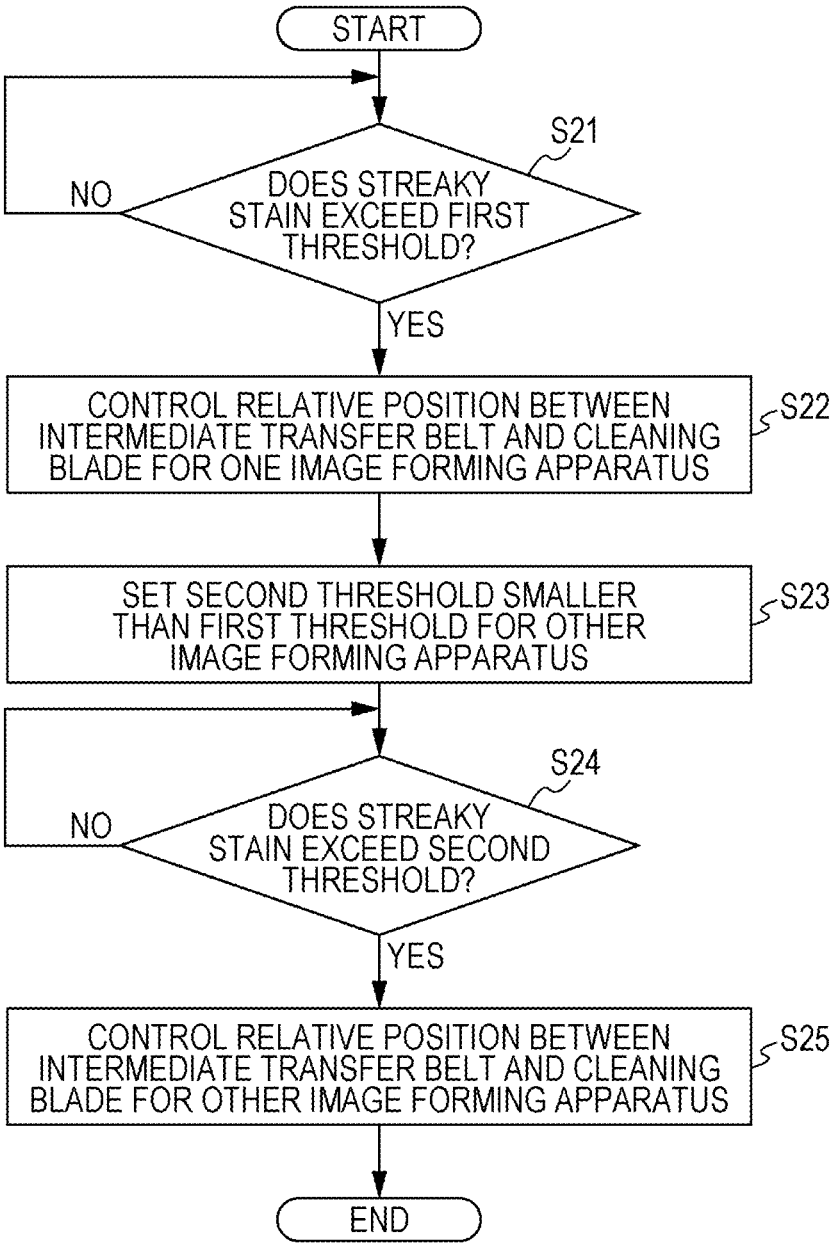
FIG. 16 is a flowchart illustrating an example of a process executed by a server.

An example of a specific process executed by the server 3 will be hereinafter described with reference to a flowchart in FIG. 16. FIG. 16 is the flowchart illustrating an example of the process executed by the server 3. This process is executed under the control of the controller 500 (more specifically, the CPU 501).

The controller 500 checks the detection results of the detectors 55 of the three image forming apparatuses 1_1, 1_2, and 1_3, and monitors whether the streaky stain exceeds the first threshold set in advance in any one of the image forming apparatuses (step S21). In a case where the streaky stain exceeds the first threshold (YES at S21), the controller 500 controls the relative position between the intermediate transfer belt 50 and the cleaning blade 54 based on the detection result of the detector 55 on the one image forming apparatus (step S22).

Next, the controller 500 sets a second threshold smaller than the first threshold for the image forming apparatus other than the one image forming apparatus in which the streaky stain exceeds the first threshold (other image forming apparatus) (step S23). Next, the controller 500 checks whether the streaky stain exceeds the second threshold in the image forming apparatus other than the one image forming apparatus (step S24). If there is the image forming apparatus in which this exceeds the second threshold (YES at S24), the controller 500 controls the relative position of the intermediate transfer belt 50 and the cleaning blade 54 on the other image forming apparatus (step S25).

As described above, under a system environment where a plurality of image forming apparatuses is installed as a network, when it exceeds the first threshold in one image forming apparatus, the following operation and effect may be obtained by setting the second threshold smaller than the first threshold for the image forming apparatus other than the one image forming apparatus.

In an environment where a plurality of image forming apparatuses is installed as a network, it may consider that a trouble such as chipping accompanying with deterioration over time of the cleaning blade 54 in a plurality of image forming apparatus usually occurs at almost the same time in general. However, even if the service person is requested to repair and replaces the cleaning blade 54 when it exceeds the first threshold in one image forming apparatus, there is a high possibility that a similar trouble occurs in the other image forming apparatuses in the near future, and in that case, it will be necessary to request the service person to repair again.

In contrast, as in this example, by changing the threshold of the image forming apparatuses other than the one image forming apparatus in which the trouble occurs to the second threshold smaller than the first threshold, it is possible to find out the image forming apparatus in which the similar trouble might occur in the near future early. In this case, it is preferable to find out the same at the same time as the timing when it is detected that it exceeds the first threshold in a certain image forming apparatus. As a result, the frequency of requesting the service person to repair when it exceeds the first threshold may be made lower than that in the case where it is fixed to the first threshold; in other words, it is possible to decrease the frequency of requesting the service person to repair.

Meanwhile, when the streaky stain exceeds the first and second thresholds and it enters the position change control, a predetermined content is displayed on the operation display unit 120 in order to request the service person to maintain. At that time, assuming that there also is a case where the maintenance is not required at the second threshold, it is possible to make the display content when it enters the position change control at the second threshold different from that when it enters the position change control at the first threshold.

(Control Program)

A series of processes executed under the control of the controller 500 described above, that is, the processes at steps S21 to S25 may be executed by an instruction of a program to the CPU 501 of the controller 500 formed of a microcomputer which is an example of a computer. It is conceivable that a control program (control program of the present invention) that allows the CPU 501 to execute the series of processes is installed in advance in the ROM 502 of the controller 500. However, there is no limitation, and it is also possible to provide the same by wired or wireless communicating means and store the same in a storage medium such as computer-readable IC card, USB memory and the like to provide.

Meanwhile, in this embodiment, in the system environment in which a plurality of image forming apparatuses 1_1, 1_2, and 1_3 and the server 3 are connected via the network 4, the server 3 has a function of monitoring the streaky stain and changing from the first threshold to the second threshold for each of the image forming apparatuses 1_1, 1_2, and 1_3, but the present invention is not limited to this. That is, the plurality of image forming apparatuses 1_1, 1_2, and 1_3 may have the above-described functions.

VARIATION

Although the present invention is described above by using the embodiment, the present invention is not limited to the embodiment described above. That is, the above-described embodiment may be variously changed or modified without departing from the gist of the present invention, and the embodiment with such change or modification is also included in the technical field of the present invention.

For example, in the above-described embodiment, the cleaning device 53 which removes the toner remaining on the surface of the intermediate transfer belt 50 being the image carrier is described as an example; however, the present invention may also be applied to the cleaning device 45 which removes the toner remaining on the surface of the photoreceptor 41 being the image carrier.

In the above-described embodiment, a copying machine is taken as an example of the image forming apparatus 1 according to one embodiment of the present invention, but the present invention is not limited to this application example. That is, the present invention may be applied to all electrophotographic image forming apparatuses such as, a printer device, a facsimile device, a printing machine, and a multifunction peripheral in addition to a copying machine.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a cleaning device including a cleaning member that abuts a surface of an image carrier and cleans a surface of the image carrier;

a detector that detects a stain generated on the surface of the image carrier in a moving direction of the surface of the image carrier;

an adjusting mechanism that adjusts a relative position between the image carrier and the cleaning member in a direction orthogonal to the moving direction; and a hardware processor that controls the relative position between the image carrier and the cleaning member by driving the adjusting mechanism based on information regarding the stain detected by the detector.

2. The image forming apparatus according to claim 1, wherein the information regarding the stain is at least one of a width of the stain, the number of stains, and an interval between a plurality of stains.

3. The image forming apparatus according to claim 2, wherein the hardware processor calculates a control amount of the relative position between the image carrier and the cleaning member based on the information regarding the stain and drives the adjusting mechanism based on the control amount.

4. The image forming apparatus according to claim 3, wherein the control amount is set to be minimum within a range in which a portion causing the stain of the cleaning member is not located in an area of the stain.

5. The image forming apparatus according to claim 2, wherein the detector includes one or more sensors, and detects the information regarding the stain by scanning the surface of the image carrier in the direction orthogonal to the moving direction.

6. The image forming apparatus according to claim 5, wherein the detector detects the information regarding the stain when an output value of the sensor exceeds a predetermined threshold.

7. The image forming apparatus according to claim 2, wherein the detector is formed of a line sensor in which a plurality of sensors is arranged in a line in the direction orthogonal to the moving direction.

8. The image forming apparatus according to claim 1, wherein the adjusting mechanism is formed of a steering mechanism that adjusts the relative position between the image carrier and the cleaning member.

9. The image forming apparatus according to claim 1, wherein, when the image carrier is an intermediate transfer belt, a period from timing when a rear end position of a residual toner image after transfer to the intermediate transfer belt passes through the cleaning member to timing when a rear end position of the stain passes through a nip part of a most downstream photoreceptor is set as a paper interval, and the hardware processor controls the relative position in the paper interval.

10. The image forming apparatus according to claim 9, wherein the hardware processor increases a driving speed of the intermediate transfer belt in the paper interval.

11. The image forming apparatus according to claim 1, wherein the hardware processor increases abutting pressure between the image carrier and the cleaning member at timing when the relative position is controlled.

12. The image forming apparatus according to claim 1, wherein, when the image carrier is an intermediate transfer belt, and a waste toner reservoir that reserves waste toner is included upstream of the cleaning member, the hardware processor discharges reserved toner in the waste toner reservoir before controlling the relative position.

13. A method of controlling an image forming apparatus provided with a cleaning device including a cleaning member that abuts a surface of an image carrier and cleans the surface of the image carrier, the method comprising:

detecting a stain generated on the surface of the image carrier in a moving direction of the surface of the image carrier; and controlling a relative position between the image carrier and the cleaning member in a direction orthogonal to the moving direction based on information regarding the stain.

14. A non-transitory recording medium storing a computer readable program of controlling an image forming system formed of a plurality of image forming apparatuses connected via a network, each of the image forming apparatuses including a cleaning device including a cleaning member that abuts a surface of an image carrier and cleans the surface of the image carrier, detecting that a stain generated on the surface of the image carrier in a moving direction of the surface of the image carrier exceeds a first threshold, and controlling a relative position between the image carrier and the cleaning member in a direction orthogonal to the moving direction based on information regarding the stain, the program causing a computer to execute:

monitoring whether the stain exceeds the first threshold for each of a plurality of image forming apparatuses;

setting, when the stain exceeds the first threshold in one image forming apparatus out of the plurality of image forming apparatuses, a second threshold smaller than the first threshold for an image forming apparatus other than the one image forming apparatus; and controlling the relative position between the image carrier and the cleaning member when the stain exceeds the second threshold in the image forming apparatus other than the one image forming apparatus.

* * * * *